US006016782A

United States Patent [19]

Henmi

[11] Patent Number: 6,016,782

[45] Date of Patent: Jan. 25, 2000

[54] ACCELERATING PUMP FOR WATERCRAFT ENGINE

[75] Inventor: Yasuhiko Henmi, Iwata, Japan

[73] Assignee: Yamaha Hatsudoki Kabushiki Kaisha, Japan

[21] Appl. No.: 09/036,765

[22] Filed: Mar. 9, 1998

[30] Foreign Application Priority Data

Mar. 7, 1997 [JP] Japan ..... 9-070697

[51] Int. Cl.[7] ..... F02M 35/10; F02M 25/00; F02B 33/04; B63H 21/12

[52] U.S. Cl. ..... 123/184.46; 123/73 A; 261/34.2; 440/88

[58] Field of Search ..... 123/73 A, 184.46; 440/88, 111; 261/34.2

[56] References Cited

U.S. PATENT DOCUMENTS

| | | | |
|---|---|---|---|
| 4,671,220 | 6/1987 | Inoue et al. | 123/73 A |
| 4,920,933 | 5/1990 | Iwai et al. | 123/73 A |
| 4,957,664 | 9/1990 | Kohno et al. | 261/34.2 |
| 5,018,503 | 5/1991 | Hoshiba et al. | 123/580 |
| 5,240,649 | 8/1993 | Yamada et al. | 261/34.2 |
| 5,489,227 | 2/1996 | Ishiida et al. | 440/77 |
| 5,647,779 | 7/1997 | Nanami | 440/38 |
| 5,749,338 | 5/1998 | Gohara et al. | 123/73 A |
| 5,906,524 | 5/1999 | Ozawa et al. | 440/88 |

*Primary Examiner*—Willis R. Wolfe
*Assistant Examiner*—Brian Hairston
*Attorney, Agent, or Firm*—Knobbe, Martens, Olson & Bear, LLP

[57] ABSTRACT

A fuel increasing mechanism for supplying fuel to an engine positioned in an engine compartment defined by a hull of a watercraft is disclosed. The engine is arranged to power a water propulsion device associated with the watercraft and has a body defining at least one combustion chamber. The engine includes an intake system for routing air to the combustion chamber, the intake system extending from the body of the engine. The fuel increasing mechanism includes an accelerating pump for supplying fuel to air passing through the intake system, the accelerating pump positioned on a side of the intake system generally opposite the body of the engine.

20 Claims, 11 Drawing Sheets

ACCELERATING PUMP FOR WATERCRAFT ENGINE

FIELD OF THE INVENTION

The present invention relates to a fuel system for an engine powering a watercraft. More particularly, the invention is an accelerating pump of a fuel system for such an engine.

BACKGROUND OF THE INVENTION

Personal watercraft generally include a water propulsion device which is powered by an internal combustion engine. These watercraft are generally quite small in size, often limited to use by a single person.

The engine of the watercraft is positioned in an enclosed engine compartment defined by a hull of the watercraft. Due to the small size of the watercraft, the engine compartment is very small, and thus the engine is arranged in fairly compact fashion therein.

When of the two-cycle variety, the engine generally has fuel delivered to incoming air for combustion via one or more carburetors. The carburetor provides a relatively simple mechanism for providing fuel (i.e. it does not require complex electronic controls which may be associated with a fuel injection system) and is relatively reliable.

In many applications, the use of a carburetor having a single fuel supplying mechanism and throttle valve is sufficient. The nature of a watercraft makes it very desirable, however, to provide a mechanism for adding a large quantity of fuel over and above the basic fuel supplying mechanism. In particular, when moving a watercraft from a trolling or stopped position to its planing position, watercraft acceleration is required. For the engine to provide the necessary acceleration, a great deal of fuel must be supplied to the engine. This amount of fuel, however, is much larger than that generally required when the engine is idling or when running at a relatively steady high speed, such as after the watercraft has planed.

As such, the carburetor may be provided with a fuel increasing mechanism or "accelerating pump" arranged to supply a large amount of fuel in certain situations. Often, this mechanism includes a fuel chamber in which a cache of fuel is stored until the necessary delivery time.

A problem exists that this fuel cache is often a fuel chamber which is located at the engine and which is subject to the very high heat generated by the engine and trapped in the small engine compartment. The exposure of the fuel cache to these high temperatures contributes to evaporation of the fuel. Since the time between period of engine acceleration may be quite high, when the need for the supply of extra fuel arises, the fuel chamber may be empty or at least depleted.

An improved accelerating pump arrangement for an engine powering a watercraft is desired.

SUMMARY OF THE INVENTION

The present invention is a fuel increasing mechanism for supplying fuel to an engine. Preferably, the engine is arranged to power a water propulsion device of a watercraft. The watercraft has a hull which defines an engine compartment in which the engine is positioned.

The engine has a body defining at least one combustion chamber. The engine includes an intake system for routing air to the combustion chamber, the intake system extending from the body of the engine.

The fuel increasing mechanism includes an accelerating pump for supplying fuel to air passing through the intake system, the accelerating pump positioned on a side of the intake system generally opposite the body of the engine.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an accelerating pump associated with a fuel system of an engine. Preferably, the engine is of the type utilized to power a watercraft, and more particularly, a personal watercraft, as this is an application for which the accelerating pump has particular advantages. It should be understood, however, that the accelerating pump may be used in other applications.

Figure 1:
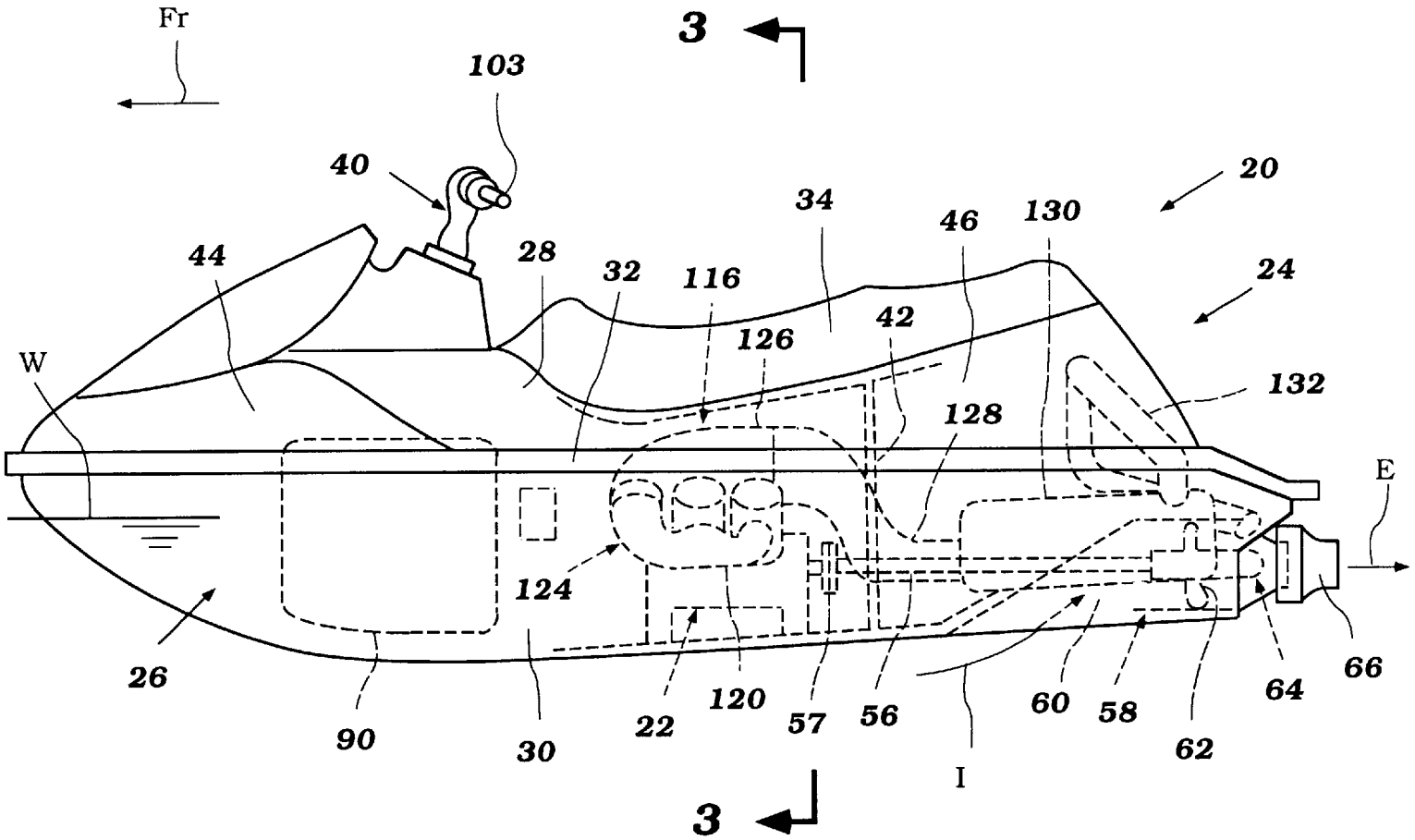
FIG. 1 is a side view of a personal watercraft of the type powered by an engine having an accelerating pump in accordance with the present invention, the engine and other watercraft components positioned within a hull of the watercraft illustrated in phantom.
Figure 2:
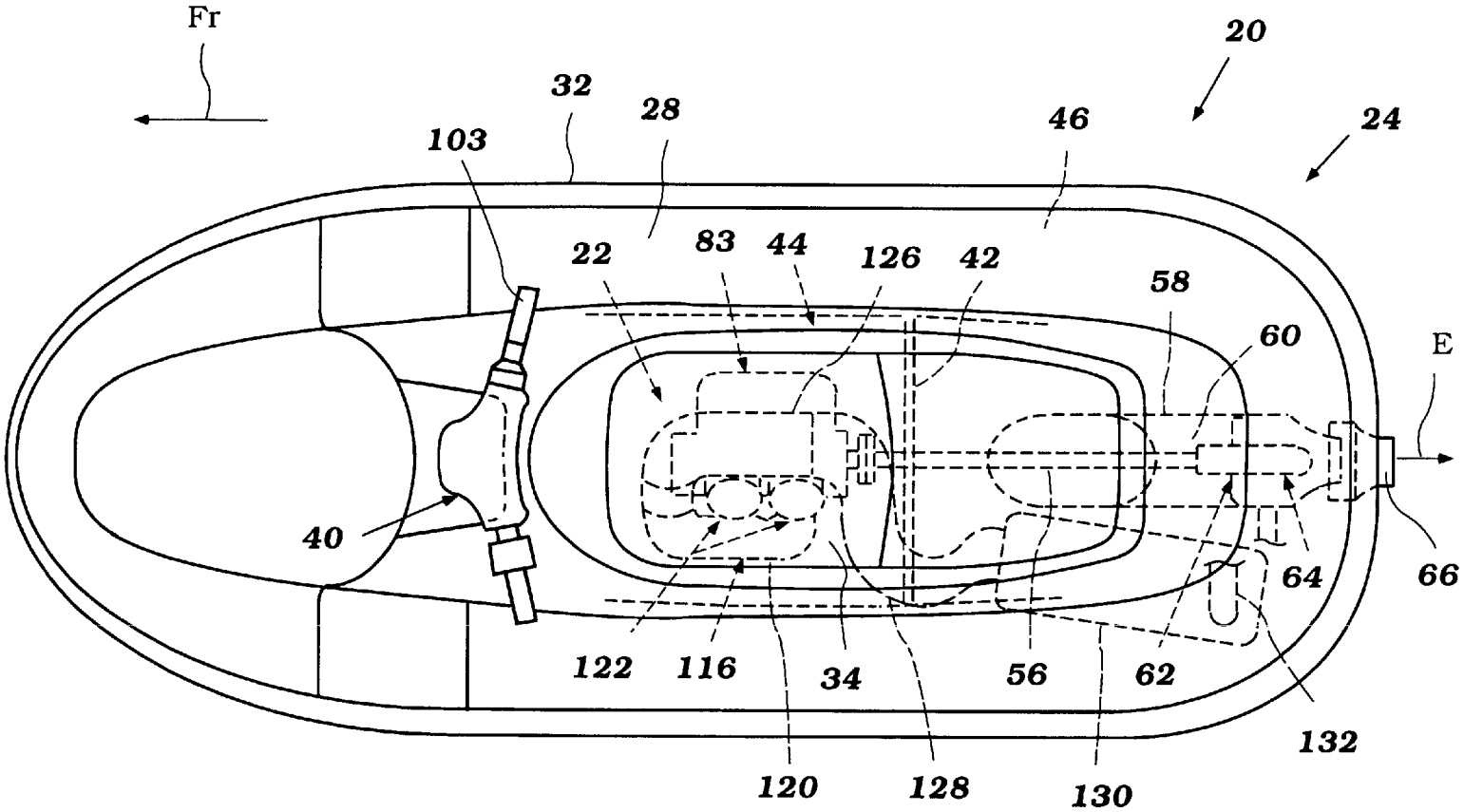
FIG. 2 is a top view of the watercraft illustrated in FIG. 1, with the engine and other watercraft components positioned within the hull of the watercraft illustrated in phantom.

FIGS. 1 and 2 illustrate a watercraft 20 having a watercraft body 24 comprising a hull 26 having a top portion or deck 28 and a lower portion 30. A gunnel 32 defines the intersection of the hull 26 and the deck 28.

A seat 34 is positioned on the top portion 28 of the hull 26. The seat 34 may be connected to a removable deck member for use in accessing an engine compartment within the hull 26, as described in more detail below. A steering handle 40 is provided adjacent the seat 32 for use by a user in directing the watercraft 20.

Figure 3:
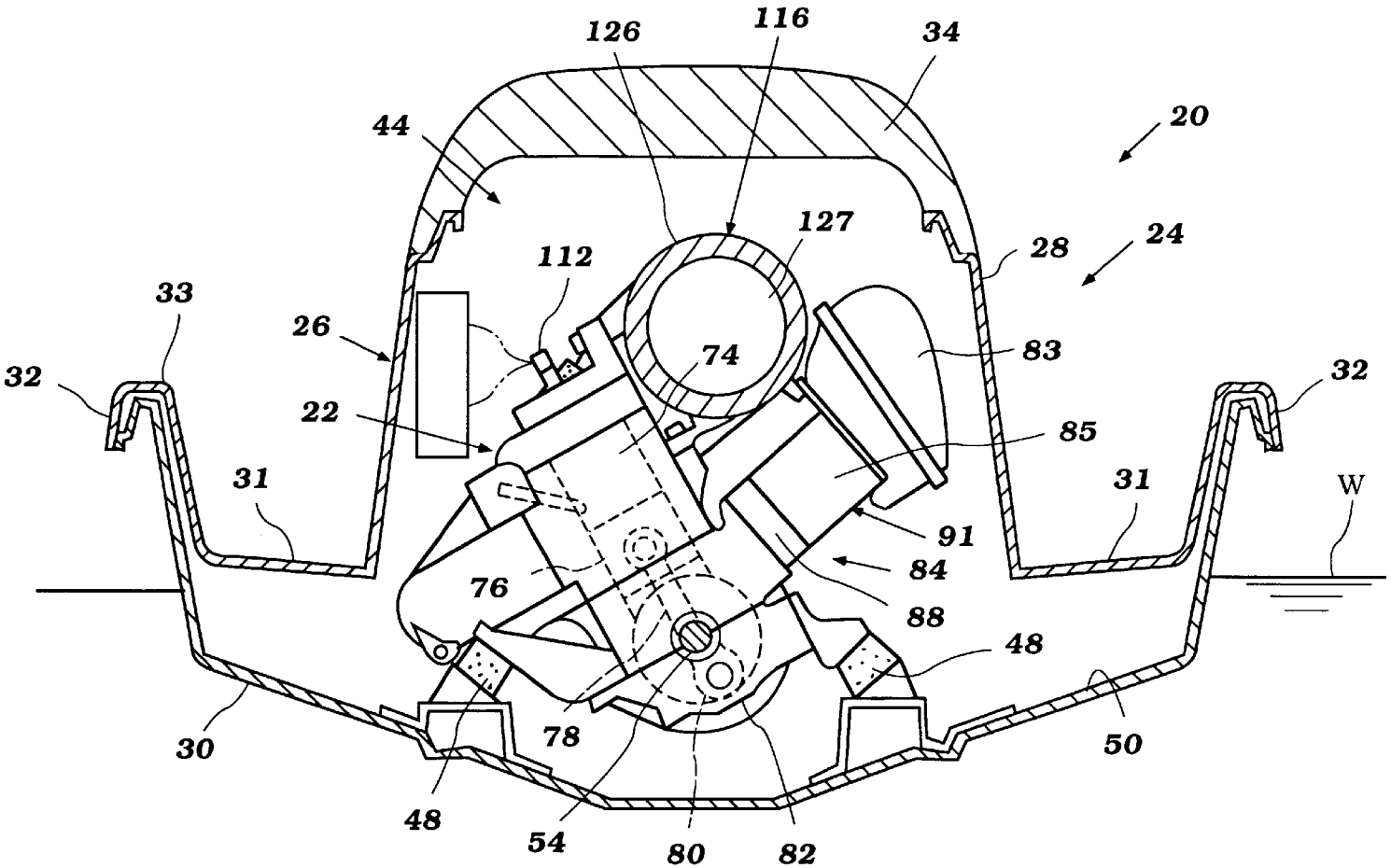
FIG. 3 is an end view, in partial cross-section, of the watercraft illustrated in FIG. 1.

A step 31 is provided between the seat 34 and a bulwark 33 defined on each side of the watercraft 20, as illustrated in FIG. 3.

The top and bottom portions 28,30 of the hull 26, along with a bulkhead 42, define an engine compartment 44 and a pumping chamber 46. An engine 22 is positioned in the engine compartment 44. As best illustrated in FIG. 3, the engine 22 is connected to the hull 26 via several engine mounts 48 connected to a bottom 50 of the lower portion 30 of the hull 26. Preferably, the engine mounts 48 include at least one section comprising a material for damping vibration transmission between the hull 26 and engine 22. The engine 22 is preferably partially accessible through a maintenance opening accessible by removing the removable deck member on which the seat 34 is mounted.

The engine 22 has a crankshaft 54 (see FIG. 3) which is in driving relation with an impeller shaft 56. The crankshaft 54 preferably extends along a centerline through the watercraft 20 from front to rear. The impeller shaft 56 rotationally drives a means for propelling water, in the form of a propulsion unit 58 which unit expels or moves water in a direction of a stem of the watercraft 20 (the stem being that end of the watercraft 20 opposite the front end, the front end facing in the direction Fr in FIG. 1). Referring to FIG. 1, an end of the crankshaft 54 extends from the engine to a coupling 57 where it is coupled to an end of the impeller shaft 56.

The propulsion unit 58 includes a propulsion passage 60 having an intake port which extends through the lower portion 30 of the hull 26 through which water ("W" in FIG. 1) is drawn in the direction I. The means for propelling water, preferably an impeller 62 driven by the impeller shaft 56, is positioned in the passage 60. The passage 60 also has an outlet 64 positioned within a nozzle 66. The nozzle 66 is mounted for movement up and down and to the left and right, for expelling water in a direction E under force, whereby the direction of the propulsion force for the watercraft 20 may be varied.

Figure 4:
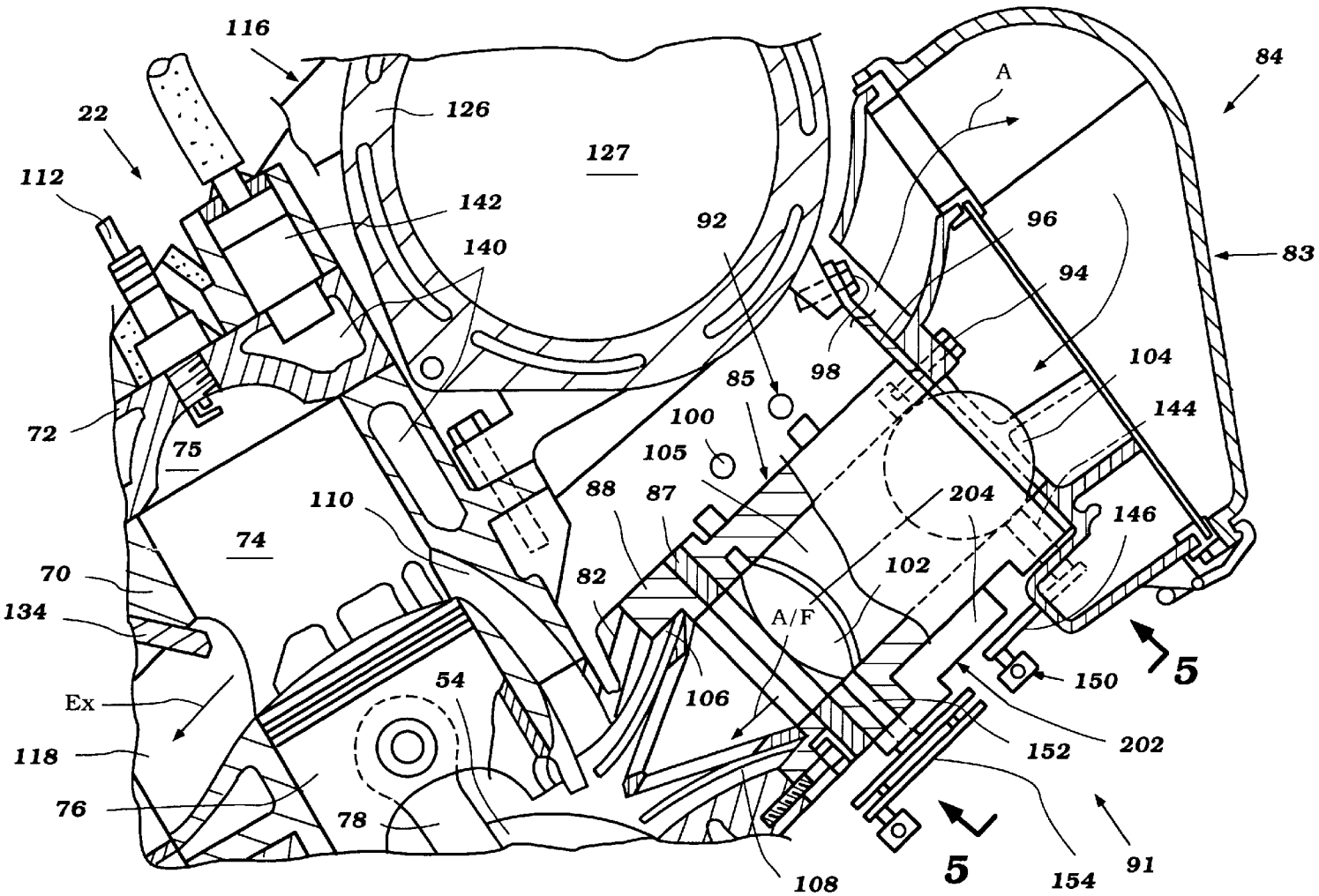
FIG. 4 is a cross-sectional end view of a portion of the engine illustrated in FIG. 1.

Referring primarily to FIG. 4, the engine 22 is preferably of the two-cylinder, two-cycle variety. Of course, the engine 22 may have as few as one, or more than two, cylinders, as may be appreciated by one skilled in the art. In addition, the engine may operate on a four-cycle or other operating principle.

The engine 22 includes a body comprising cylinder block 70 having a cylinder head 72 connected thereto and cooperating therewith to define two cylinders 74. Each cylinder 74 is defined by a cylinder wall within the block 70 and a recessed area in the cylinder head 72, with a portion thereof above a head of a piston 76 serving as a combustion chamber 75. Each piston 76 is connected to the crankshaft 54 via a connecting rod 78, as is well known in the art.

Referring to FIG. 3, the crankshaft 54 is rotatably journaled by a number of sealed bearings with respect to the cylinder block 70 within a crankcase chamber 80. Preferably, the chamber 80 is defined by a crankcase cover member 82 which extends from a bottom portion of the cylinder block 70. As is well known, the crankshaft 54 has pin portions extending between web portions thereof, with each connecting rod 78 connected to one of the pin portions and the web portions rotatably supported by the bearings mounted to members extending from the block 70 and cover 82.

As best illustrated in FIGS. 3 and 4, the engine 22 includes means for providing an air and fuel mixture to each combustion chamber 75. Preferably, air is drawn into the engine compartment 44 through one or more air inlets in the hull 26. Air is then drawn through an intake system 84 including an intake or air box 83, a passage 105 defined by a body 85 of a carburetor 91 and a passage 86 through an intake manifold 88 leading into the crankcase chamber 80 of the engine 22.

As illustrated, the air box 83 is preferably connected to a first end of the carburetor 91 with one or more fasteners 94. A mounting plate 96 extending between the carburetor body 85 and air box 83 is connected to the cylinder block 70 with one or fasteners 98, providing secure mounting of the air box 83 and carburetor 91.

The end of the carburetor 91 opposite the air box 83 is mounted to the intake manifold 88 via a coupling plate 87. One or more fasteners then join the intake manifold 88 to the crankcase cover 82 portion of the engine 22.

Fuel is provided to each cylinder 74 for combustion. Preferably, fuel is combined with the incoming air passing through the passage 105 of the carburetor 91. In particular, fuel is drawn from a fuel tank 90 (see FIG. 1) positioned in the engine compartment 44 by a fuel pump (not shown) and delivered through a fuel delivery line 92 to a charge former, which in this case comprises the carburetor 91. Fuel which is delivered to the carburetor 91 but not delivered to the air flowing therethrough may be returned to the fuel tank 90 through a return line 100.

Referring to FIG. 4, a throttle valve 102 and a choke valve 104 movably mounted in the passage 105 for allowing the watercraft operator to control the rate of fuel and air delivery to the engine 22 for controlling the speed and power output of the engine via a throttle linkage and choke linkage of the carburetor 91. Preferably, the throttle valve 102 is moveable from a throttle control 103 positioned on the steering handle 40 of the watercraft 20.

The details of the carburetor 91 and the throttle valve 102 and choke valve 104 control will be described in more detail below.

The air and fuel mixture (labeled A/F in FIG. 4) selectively passes through an intake port 106 into the crankcase chamber 80 as controlled by a reed valve 108, as is known in the art. As is also well known, an intake port and corresponding reed valve 108 are preferably provided corresponding to each cylinder 74. The crankcase chamber 80 is compartmentalized so as to provide a crankcase compression feature for each combustion chamber as is well known in the operation of two-cycle engines.

The fuel and air charge within the crankcase chamber 80 is delivered to its respective combustion chamber 75 through at least one scavenge passage 110 leading to one or more scavenge ports in the cylinder wall.

A suitable ignition system is provided for igniting the air and fuel mixture provided to each combustion chamber. Preferably, this system comprises a spark plug 112 having its electrode tip positioned in the combustion chamber 75. Each spark plug 112 is preferably fired by a suitable ignition system.

Though not illustrated, the engine 22 may include a flywheel connected to one end of the crankshaft 54 and having a number of magnets thereon for use in a pulsar-coil arrangement for generating firing signals for the ignition system. In addition, the ignition system may include a battery for use in providing power to an electric starter and other electrical engine features. In addition, a number of teeth may be mounted on the periphery of the flywheel for use in starting the engine 22 with a starter motor (not illustrated).

The engine 22 includes a lubricating system for providing lubricating oil to the various moving parts thereof. Preferably, the lubricating system includes an oil tank or reservoir (not shown) from which lubricating oil is delivered to and circulated throughout the engine, as is well known to those skilled in the art.

Referring to FIGS. 1, 2 and 4, exhaust gas (labeled "Ex" in FIG. 4) generated by the engine 22 is routed from the engine to a point external to the watercraft 20 by an exhaust system 116 which includes an exhaust passage 118 leading from each combustion chamber 74 through the cylinder block 70. A manifold part 120 of the exhaust system 116 is connected to a side of the engine 22. The manifold 120 has two branch portions 122 each having a passage therethrough, each passage through a branch portion 122 aligned with one of the passages 118 leading through the cylinder block 70. Exhaust generated in each combustion chamber 75 is routed through a respective passage 118 into a branch 122 of the manifold 120.

Figure 5:
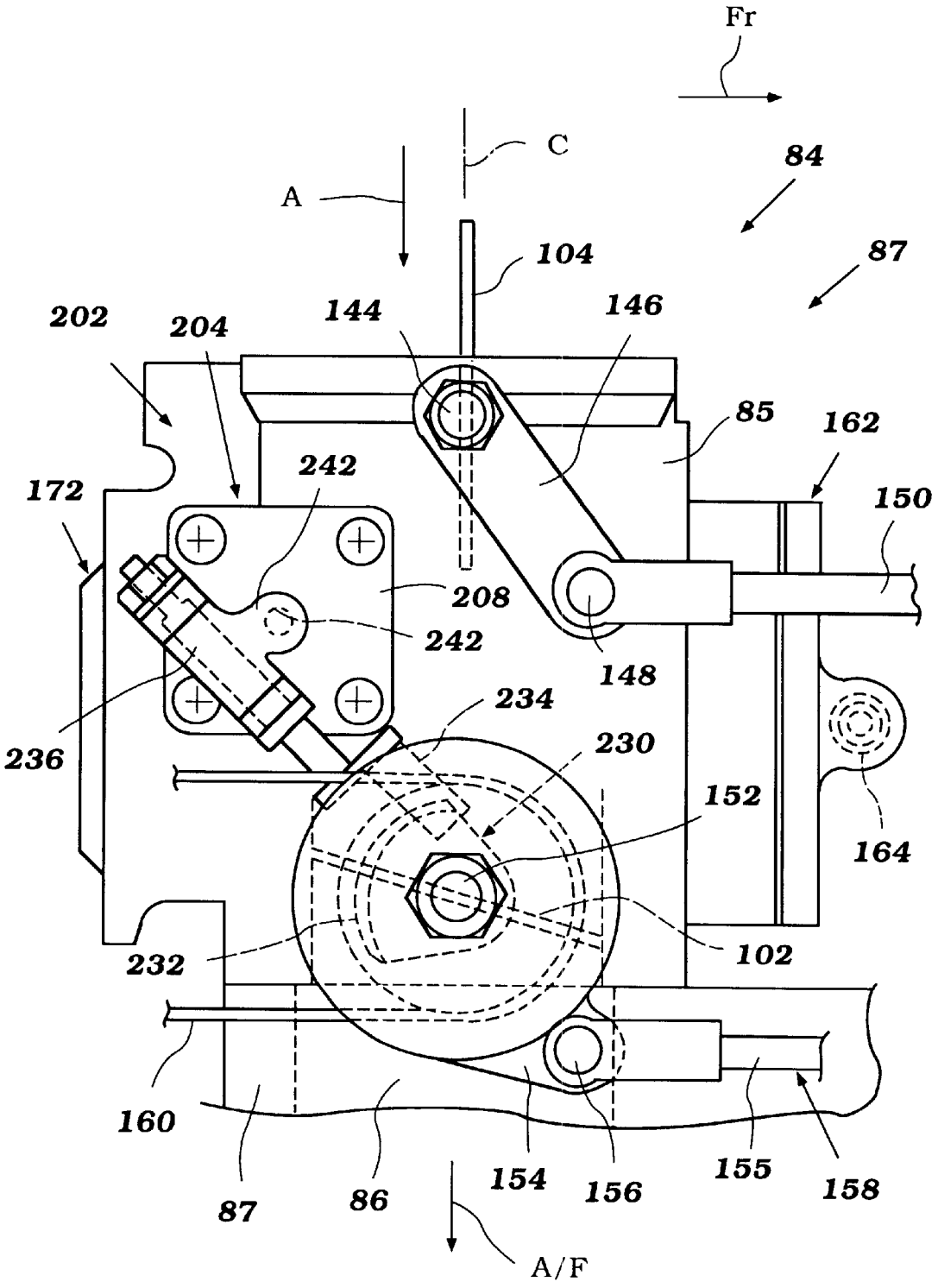
FIG. 5 is a side elevation view of a carburetor of the engine as viewed in the direction of line 5—5 in FIG. 4.
Figure 7:
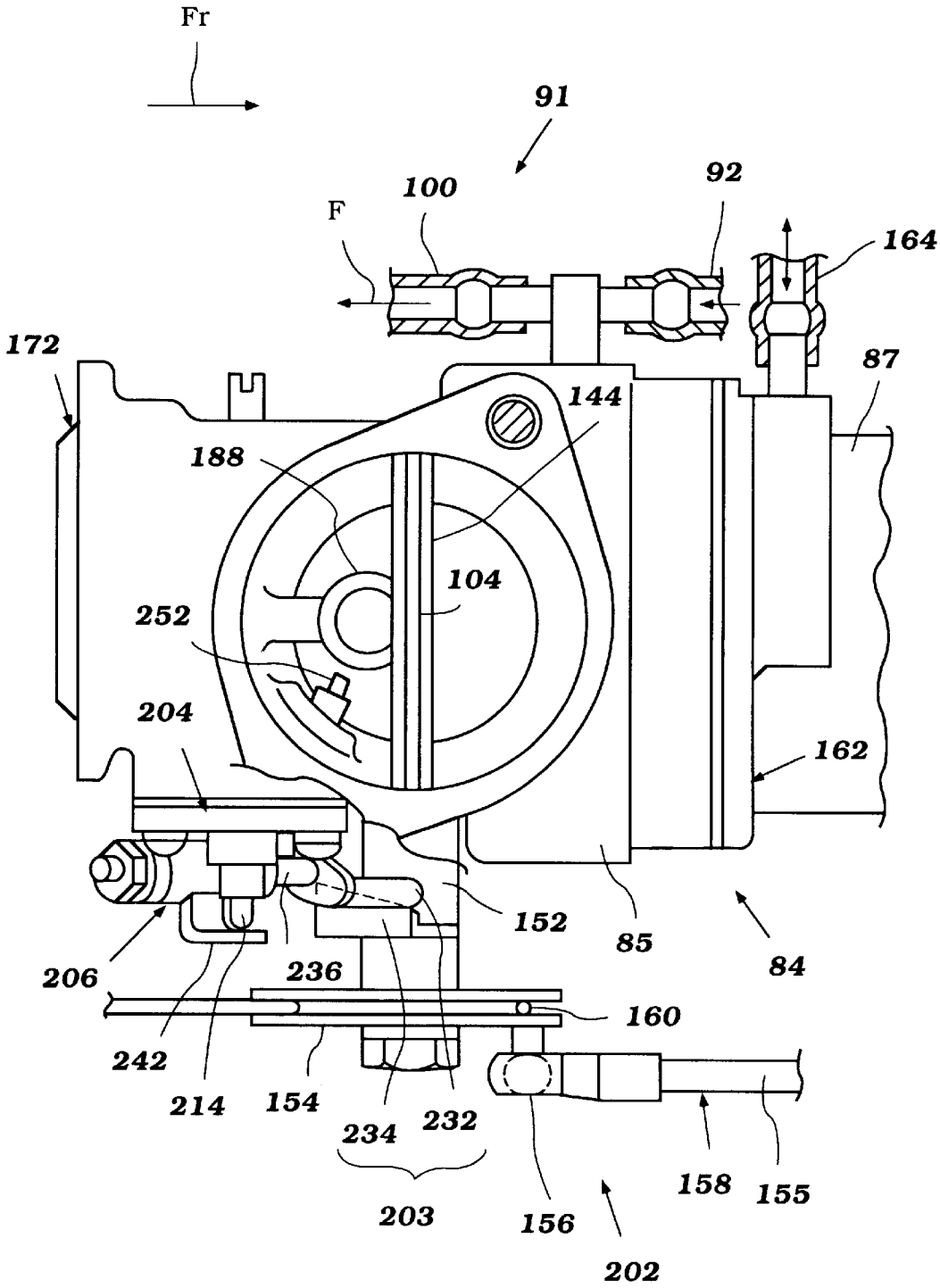
FIG. 7 is top view of the carburetor of the engine with an air box associated therewith removed.

The passages through each branch 122 of the manifold 120 merge into a single pipe part 124 having a passage 125 therethrough (See FIGS. 5 and 7). The pipe part 124 of the manifold 120 leads to an expansion pipe 126 part of the exhaust system 116. This expansion pipe 126 has a passage 127 therethrough which preferably includes an enlarged part or chamber through which exhaust routed.

Figure 6:
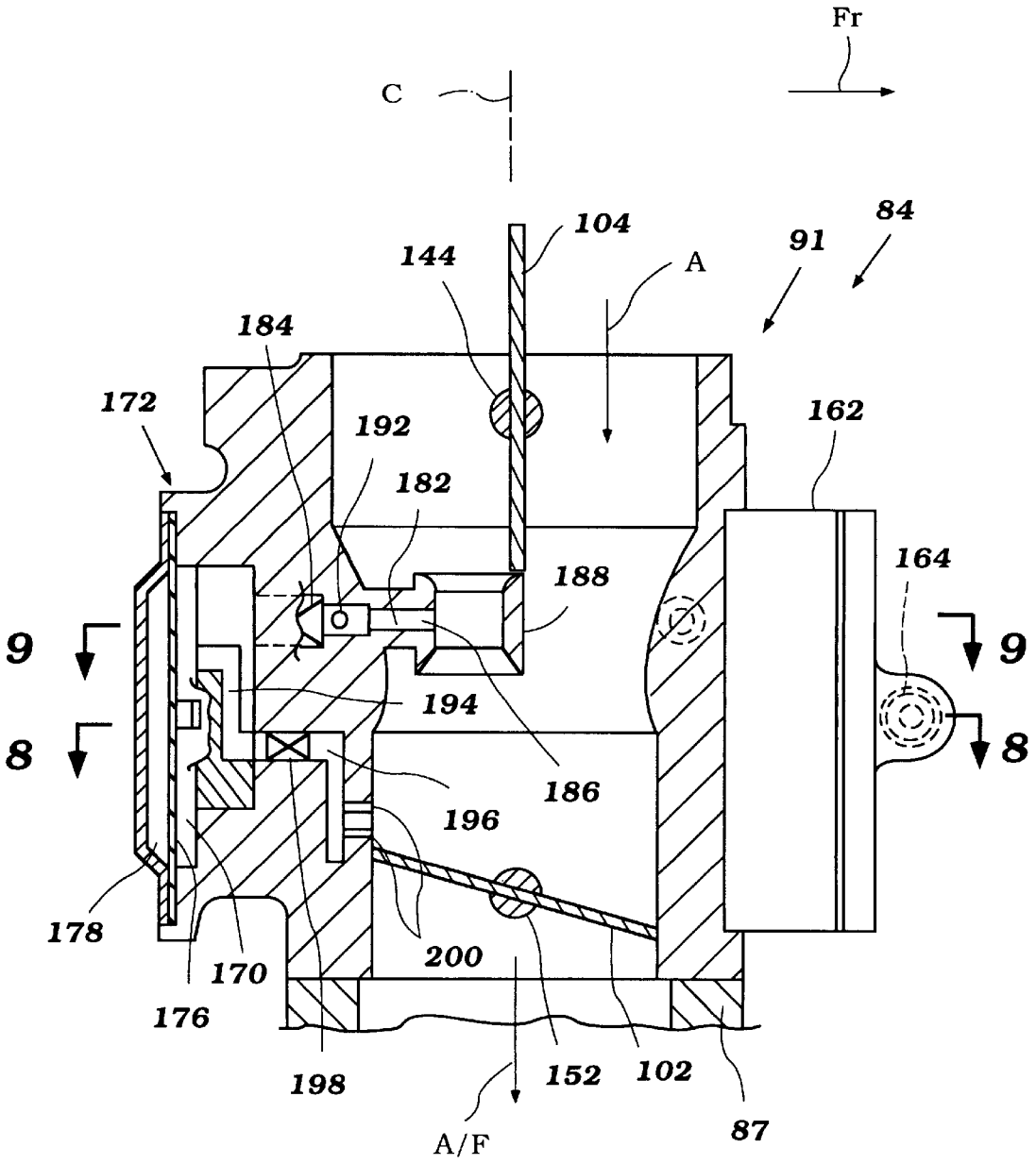
FIG. 6 is a cross-sectional view of the carburetor illustrated in FIG. 5 taken along a centerline C.

As illustrated in FIG. 6, exhaust flows from the expansion pipe 126 into an upper exhaust pipe 128. The upper exhaust pipe 128 preferably narrows to a smaller diameter from the enlarged expansion pipe 126. The upper exhaust pipe 128 routes exhaust to a water lock 130. The upper exhaust pipe 128 is preferably connected to the water lock 130 via a flexible fitting, such as a rubber sleeve. The exhaust flows through the water lock 130, which is preferably arranged as known to those skilled in the art, and then passes to a lower exhaust pipe 132 which has its terminus in the propulsion passage. In this manner, exhaust flows from the engine 22 through the exhaust system to its discharge within the water flowing through the passage 60. A catalyst (not shown) may be positioned within the exhaust system 116 for catalyzing the exhaust gases.

Means are preferably provided for controlling the flow of exhaust gases through the exhaust passages 118 from combustion chamber 75. As illustrated, this means comprises a sliding-knife type valve 134, but may comprise a rotating or other type valve, and means for moving the valve, as well known to those skilled in the art.

Preferably, a cooling system is provided for cooling the engine 22. Such cooling systems are well known to those of skill in the art and as such is not described in detail herein. Preferably, the cooling system routes liquid coolant to one or more coolant jackets 140 associated with the engine 20. A water temperature sensor 142 may be provided for measuring the coolant temperature for use in a coolant control system.

The carburetor 91 will now be described in detail with reference to FIGS. 4–10. In general, the carburetor 91 is of the float-less variety, and includes an accelerating pump for providing an addition amount of fuel to the engine 20 over and above that provided by a main fuel delivery mechanism.

Referring primarily to FIGS. 4 and 5, the choke valve 104 comprises a plate which is mounted to a choke shaft 144. This shaft 144 is mounted for rotation with respect to the body 85 of the carburetor 91. A first end of a choke lever 146 is connected to an end of the choke shaft 144 which extends beyond the outside of the body 85. A second end of the lever 146 is rotatably connected to a choke linkage 150 by a pin 148. Though not shown, the choke valve 104 is moved by a cable or similar control which is actuated by the control 103 (such as a throttle grip) at the steering handle 40.

Similarly, the throttle valve 102 comprises a plate which is mounted to a shaft 152. This throttle shaft 152 is mounted for rotation with respect to the body 85 of the carburetor 91. A first end of a throttle lever 154 is connected to an end of the shaft 152 which extends beyond the body 85. A second end of the lever 154 is rotatably connected to a throttle linkage 155 of an operating mechanism 158 via a pin 156. The throttle lever 154 is actuated remotely from the throttle grip or control 103 at the steering handle 40 through a cable 160.

In the instant arrangement, a separate intake, and thus carburetor 91, is provided corresponding to each of the two cylinders 74 of the engine 20. Thus, the throttle link 155 and choke link 150 each extend to a corresponding throttle lever and choke lever (not shown) of the carburetor for the other cylinder. In this fashion, rotation of the throttle lever 154 with the cable 160 effectuates rotation of the lever associated with the other carburetor via the linkage 155. As well known to those of skill in the art, a variety of other throttle and choke operating mechanism arrangements may be provided.

As illustrated in FIG. 5, the throttle valve 102 and choke valve 104 are mounted for rotation about a centerline C which extends through the passage 105 of the carburetor 91.

Figure 9:
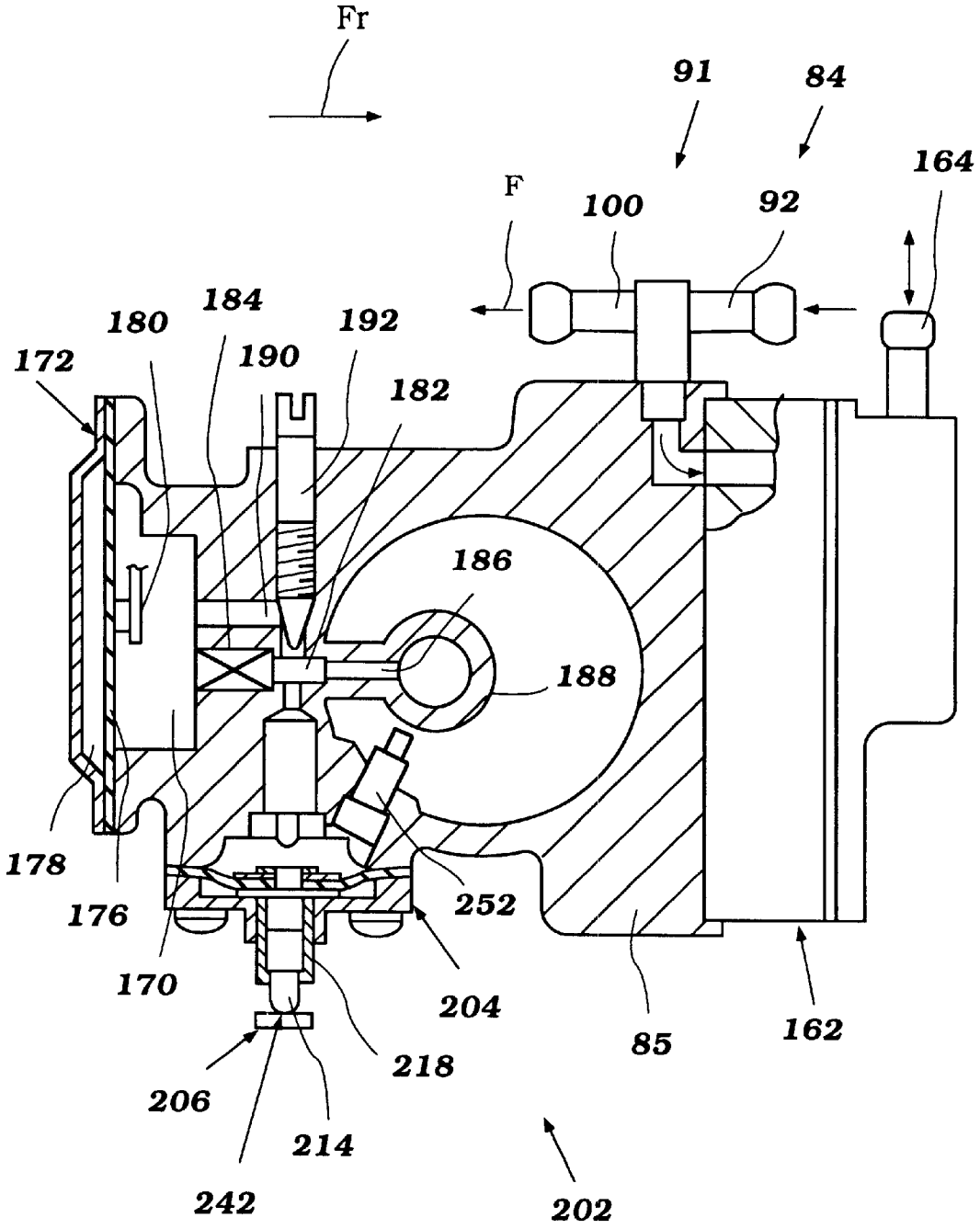
FIG. 9 is a cross-sectional view of the carburetor illustrated in FIG. 6 taken along line 8—8 therein.

Fuel which is delivered to the carburetor 91 is pressurized and delivered into the air stream through the passage 105 with a fuel pump 162 (this pump 162 may be additional to the above-referenced pump which may be used to deliver fuel from the fuel tank 90 to the carburetor 91). Referring to FIG. 9, fuel is delivered through the supply line 92 to the pump 162. The pump 162 is preferably of the diaphragm operated or actuated type. As such, the pump 162 has fuel chamber (not shown) on one side of a diaphragm (not shown) and an air chamber (not shown) on the opposite side of the diaphragm. Air pressure pulses are provided to the air chamber through a pipe 164. This pipe 164 may lead to the crankcase or the like.

Figure 8:
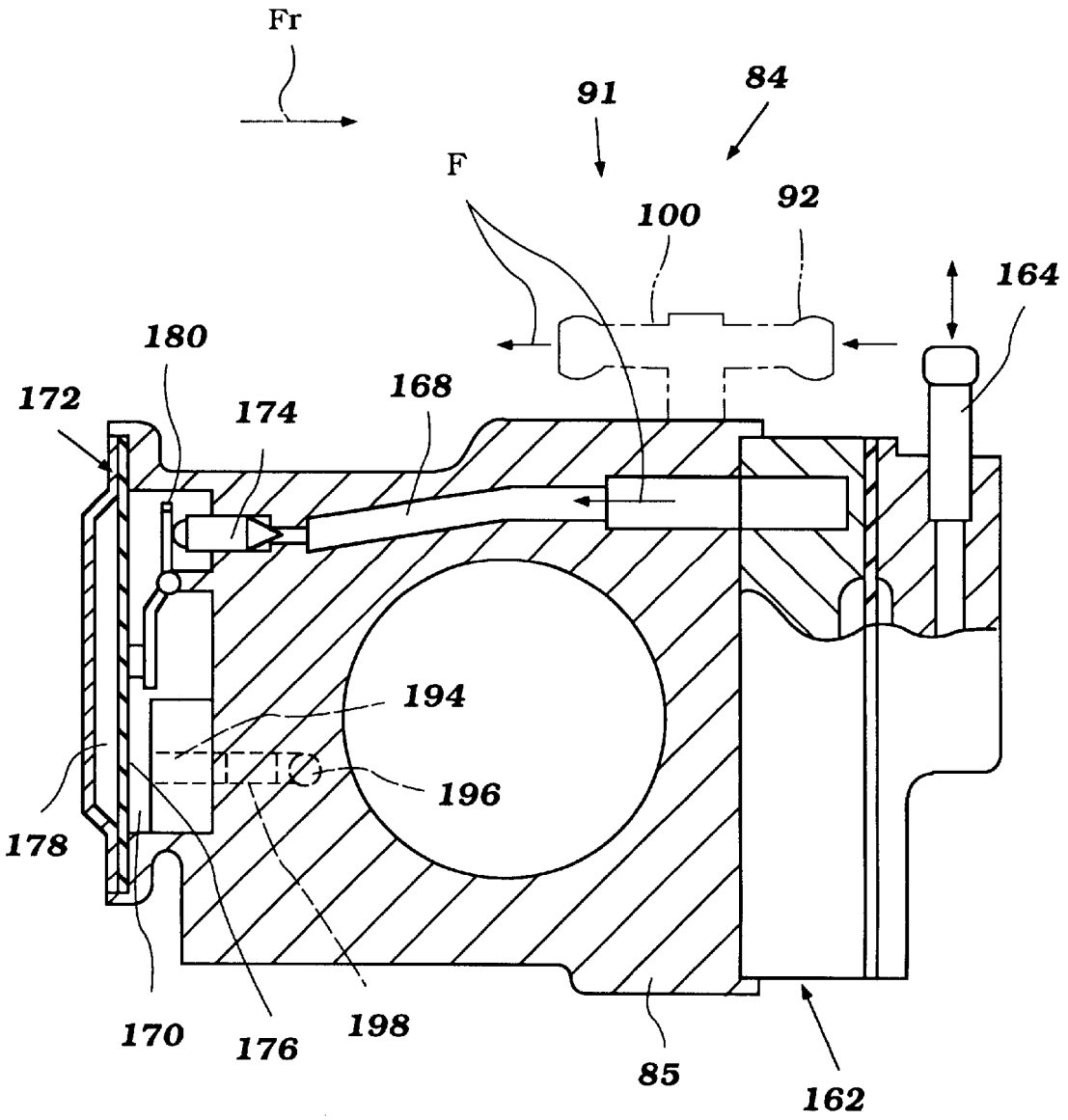
FIG. 8 is a cross-sectional view of the carburetor illustrated in FIG. 6 taken along line 8—8 therein.

Referring to FIG. 8, the fuel pump 162 supplies fuel to a fuel chamber 170 through a delivery passage 168. Preferably, the flow of fuel is governed by a fuel flow mechanism 172. This mechanism or means comprises a diaphragm operated valve 174. As illustrated, the valve 174 is a one-way type valve positioned along the delivery passage 168. The valve 174 is arranged to open and close dependent upon the movement of a diaphragm 176. In this arrangement, an atmospheric chamber 178 is provided on one side of the diaphragm 176, while the fuel chamber 170 is provided on the other. A lever member 180 is connected to the diaphragm 176 and the valve 174, whereby the valve 174 is moved in response to movement of the diaphragm 176.

Referring to FIGS. 6 and 9, fuel which fills the fuel chamber 170 is delivered through a main supply passage 182 as governed by a valve 184. The valve 184 is preferably a one-way check valve preventing the reverse flow of fuel towards the chamber 170. This main passage 182 leads to a nozzle 186 positioned in a venturi member 188 located in the passage 105 through the body 85 of the carburetor 91.

Means are provided for adjusting the primary fuel supply. Preferably, this means comprises a secondary fuel passage 190 leading from the fuel chamber 170 to a point along the main passage 182 downstream of the valve 184, and means for controlling the flow rate of fuel through the secondary passage 190. This means for controlling comprises a needle valve 192. The needle valve 192 threadingly engages the body 85 of the carburetor 91 and is arranged to selectively open and close the secondary passage 190, whereby an operator of the craft 20 may control the flow rate of additional fuel which is provided to the main passage 182, and thus the total flow rate of fuel supplied to the engine 20.

Generally, the rate at which fuel is supplied to the engine 20 is dependent upon the rate at which air flows through the passage 105, and thus the throttle valve angle. Of course, at idle the throttle valve 102 is generally closed, such that the fuel will generally not be supplied through the main passage 182.

Referring to FIG. 6, an idle fuel delivery mechanism is provided. This mechanism comprises an idle fuel supply passage 194 which extends generally downwardly from the fuel chamber 170 (from a point generally below the fuel level therein) to a connecting passage 196 in the body 85 of the carburetor 91 which extends to a one or more idle supply ports 200 in the passage 105. Preferably, a one-way check valve 198 is again provided in the passage 196 for preventing the back-flow of fuel into the chamber 170.

As illustrated, the ports 200 are located upstream of the throttle valve 102. As such, one or more small air holes may be provided through the throttle valve 102 for providing an idle flow of air and fuel. Alternatively, the valve 102 may be prevented from completely closing. The ports 200 may be provided downstream of the throttle valve 102.

A fuel increasing mechanism 202 is associated with the carburetor 91 for providing an additional amount of fuel beyond that normally provided from the chamber 170 to the passage 182 when the operator wishes to accelerate the speed of the engine 20. Preferably, this mechanism 202 includes means for supplying fuel and means for actuating the supply mechanism. The means for supplying fuel comprises an accelerating pump 204 and the means for actuating comprises an operational linkage 205.

Figure 10:
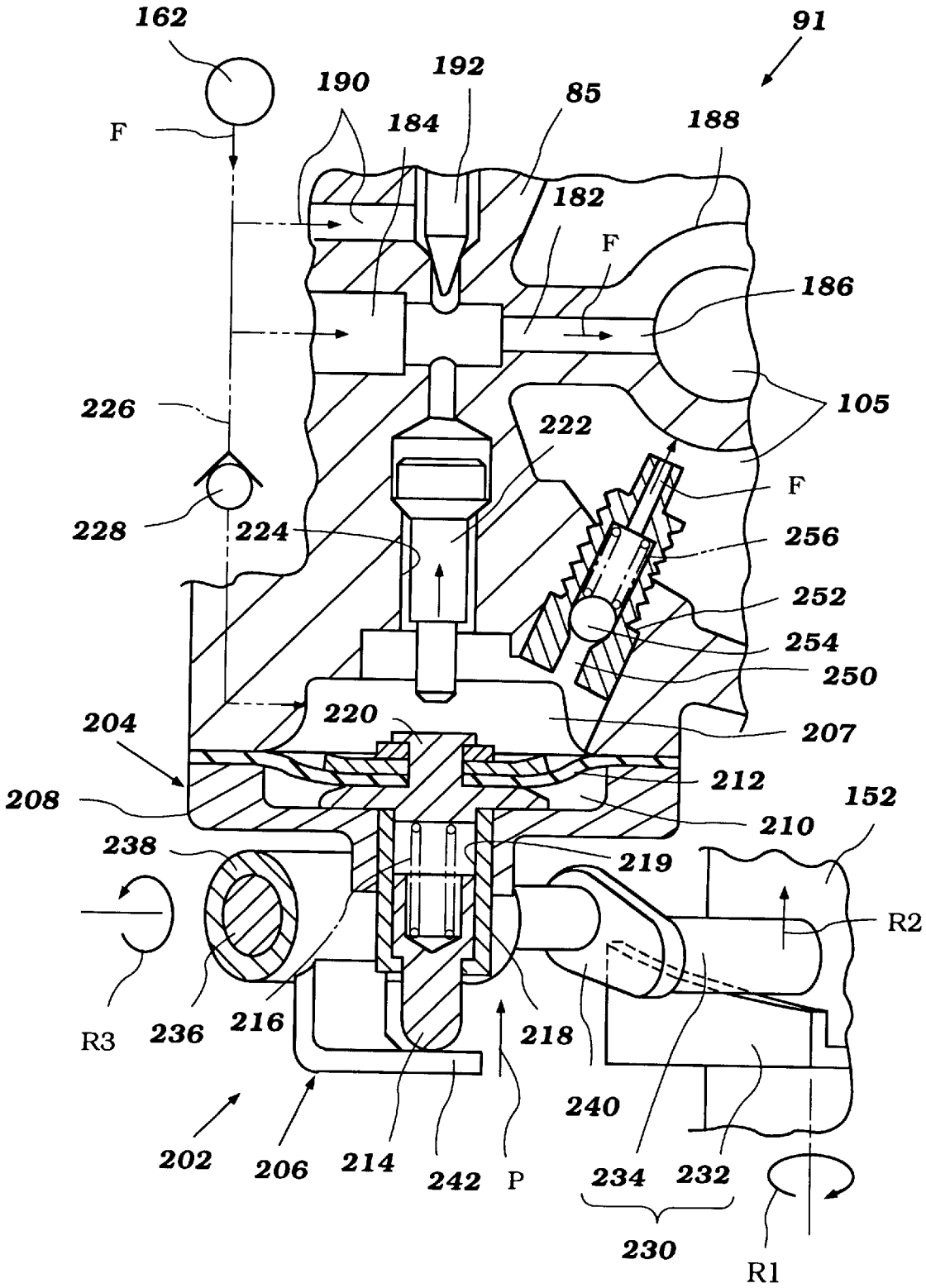
FIG. 10 is yet another cross-sectional view of the carburetor.

The pump 204 will be described primarily with reference to FIG. 10. As illustrated, an accelerating fuel supply chamber 206 is defined by the body 85 of the carburetor 91 and an attached pump housing cover 208. An atmospheric or air chamber 210 is divided from the fuel chamber 206 by a diaphragm 212.

The pump 204 includes a piston 214 which is biased in a direction away from the diaphragm 212 by a spring 216. The piston 214 is movable in an axial direction along a passage 219 through a sleeve 218 which extends from the housing 208. The spring 216 is positioned between the piston 214 and a plunger 220 connected to the diaphragm 212.

When the plunger 220 moves inwardly, it is arranged to engage a valve 222 which is positioned in an accelerating fuel supply passage 224. This passage 224 leads from the accelerating fuel supply chamber 206 to the main fuel supply passage 182. Normally, the valve 222 in this passage 182 is arranged to preclude the flow of fuel from the chamber 206 to the main passage 182.

Fuel is supplied to the chamber 206 through a supply passage 226 which leads to the delivery passage 168 (see FIG. 8). A one-way valve 228 is positioned along this passage 226 for preventing the reverse flow of fuel from the chamber 206 to towards the pump 162.

A fuel delivery path 250 also leads from the chamber 206 to the passage 105 through the carburetor 91. A pressure-activated valve 252 is associated with the passage 250 to selectively open and close it. This valve 252 includes a ball 254 which is biased by a spring 256 into a position in which the ball 254 obstructs the passage 250. When the pressure within the chamber 206 becomes sufficiently high, the ball 254 is moved along the passage 250 in the direction of the passage 105 to a position in which fuel is allowed to flow through the passage 250 (the ball 254 moves into an enlarged section of the passage 250 defined through the valve 252).

The operational linkage 206 by which the pump 204 is operated will be described also with reference primarily to FIG. 10. As illustrated, a cam mechanism 230 is provided which comprises a cam surface 232 attached to the throttle valve shaft 152, and a follower element 234 which engages this surface 232.

The cam surface 232 is a sloping surface defined by an extension of the shaft 152 positioned outside of the body 85 of the carburetor 91. The follower element 234 is a cylindrical extension of a drive rod 236. As illustrated, the drive rod 236 has a first end which is rotatably supported to the body 85 of the carburetor 91. The rod 236 extends at an angle therefrom towards the throttle shaft 152. Preferably, the cylindrical extension of the rod 236 which comprises the follower element 234 is offset by an offset member 240 of the rod (whereby the centerline through the part of the rod 236 which is supported by the sleeve 238 is offset from the centerline through the extension portion of the rod 236 which acts as the follower element).

The rod 236 is arranged to drive a sleeve 238 having a piston engaging member 242 extending therefrom. The piston engaging member 240 is an "L"-shaped member having a surface which engages an end of the piston 214 which extends beyond its sleeve 218.

In operation, when the throttle control is moved to accelerate the engine 20, the throttle shaft 152 rotates in the direction R1 illustrated in FIG. 1. When this occurs, the follower element 234 is moved in the direction R2 as it rides along the cam surface 232. Rotation of the follower element in the direction R2 causes the sleeve 238 to rotate in the direction R3, and thus move the piston engaging member 240 and thus piston 214 in the direction P.

When the piston 214 moves inwardly, it overcomes the spring force and pushes the diaphragm 212 inwardly. If the fuel pressure becomes very high in the fuel chamber 206, some of the fuel is supplied through the passage 250 when the valve 252 opens. In this manner, addition fuel is provided to the air passing through the passage 105.

If the piston 214 is moved further inwardly, the plunger 220 will engage a portion of the valve 222 and open the accelerating fuel passage 224 which leads to the main passage 182. Then extra fuel is also delivered to the engine 22.

In accordance with the present invention, the accelerating pump 204 is positioned on a side of the body 85 of the carburetor 91 which is generally opposite the body of the engine 22, including the cylinder block 70. In this manner, less heat is transmitted from the body of the engine 22 to the pump 204. The fuel supplied to the chamber 206 evaporates at a much slower rate, so that when additional fuel must be supplied to the engine 22, fuel is in the chamber 206 ready for instantaneous delivery.

In fact, in this arrangement, the accelerating pump 204 faces downwardly towards the bottom 50 of the hull 26.

Figure 11:
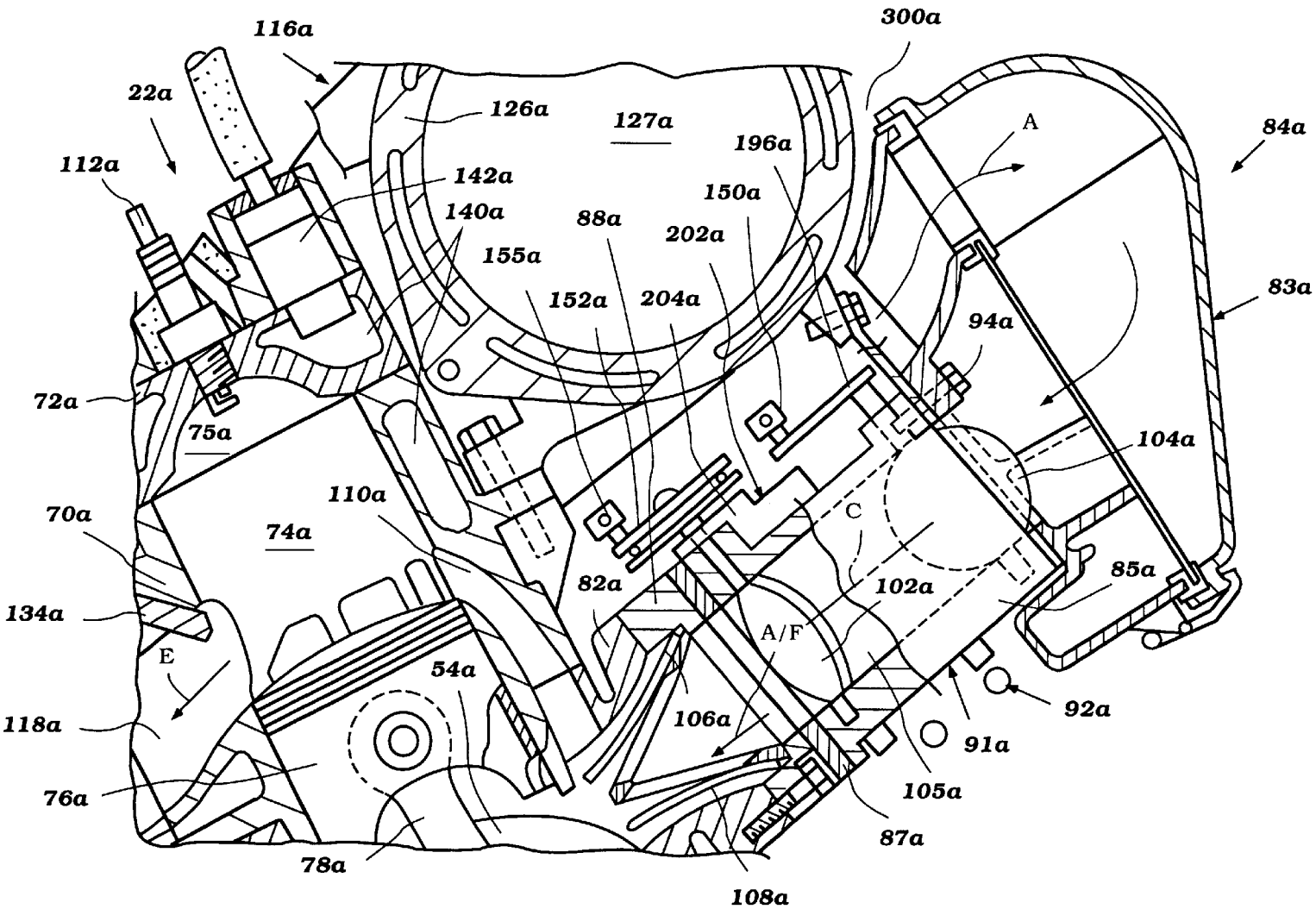
FIG. 11 is a cross-sectional end view of a portion of an engine powering a watercraft, the engine having a carburetor with an accelerating pump arranged in accordance with a second embodiment of the present invention.

A second embodiment of the invention is illustrated in FIG. 11. In the illustration and description of this embodiment, like reference numerals will be used to designate like or similar parts to those of the first embodiment, except that an "a" designator has been added to all of the reference numerals of this embodiment.

In this embodiment, the fuel increasing mechanism **202*a* is provided in a space 300*a* provided between the intake 84*a* and body of the engine 22*a*. Advantageously, (and as in the case of the first embodiment illustrated in FIG. 4) the engine 22*a* is arranged so that the intake 84*a* extends at an angle outwardly from the crankcase 82*a* of the engine 22*a*. In addition, the body of the engine 22***a* is tilted so that the axis along which the cylinders 74*a* extend are to one side of vertical. The intake 84*a*, on the other hand, extends to the opposite side of vertical. In this configuration, a "V"-shaped space 300*a* is provided between the body of the engine 22*a* and the intake 84*a*.

Because air may freely flow through this area upwardly, the heat from the engine 22*a* is not substantially transmitted to the adjacent carburetor 91*a*. As such, the accelerating pump 204*a* is conveniently located on the side of the body 85*a* of the carburetor 91*a* which faces the engine 22*a*. While this permits a very compact engine arrangement, it still permits the accelerating pump 204*a* to operate efficiently.

Of course, the foregoing description is that of preferred embodiments of the invention, and various changes and modifications may be made without departing from the spirit and scope of the invention, as defined by the appended claims.

What is claimed is:

1. An engine for powering a water propulsion device of a watercraft, the watercraft having a hull defining an engine compartment, said engine being positioned in said engine compartment and comprising an engine body defining at least one combustion chamber, said engine including an intake system for routing air to said combustion chamber, said intake system extending from said engine body and defining an air intake path into said engine, a primary fuel supply mechanism for supplying fuel to said engine, and a fuel increasing mechanism including an accelerating pump for supplying an amount of fuel to said engine in addition to that provided by said primary fuel supplying mechanism, said accelerating pump positioned on a side of said intake system generally opposite said engine body with said air intake path disposed generally between said accelerating pump and at least one combustion chamber of said engine body.

2. The engine of claim 1, further including an actuating mechanism associated with said pump.

3. The engine of claim 1, wherein said intake system includes a carburetor and said accelerating pump is positioned on said carburetor.

4. The engine of claim 3, wherein said carburetor includes a throttle valve having a throttle shaft, and the fuel increasing mechanism additionally includes means for activating said pump in response to movement of said shaft.

5. The engine of claim 1, wherein said pump includes a fuel supply chamber.

6. The engine of claim 1, wherein said combustion chamber comprises a portion of a cylinder, said cylinder extending along an axis that is inclined relative to a vertical axis.

7. The engine of claim 6, wherein said intake system extends from said body of said engine in a direction away from said vertical axis on an opposite side of said engine.

8. The engine of claim 1, wherein said accelerating pump is positioned on a lower side of said intake system.

9. A watercraft having a hull defining an engine compartment, the engine being positioned in the engine compartment and driving a propulsion device, the engine comprising an engine body that is defined between two ends of the engine and that defines at least one combustion chamber, the engine including an intake system that routes air to the combustion chamber, the intake system extending from the engine body along a side of the engine body, a primary fuel supply mechanism supplying fuel to the engine, and a fuel increasing mechanism including an accelerating pump that supplies an amount of fuel to the engine in addition to that provided by the primary fuel supplying mechanism, the accelerating pump being disposed to a side of the engine body and on a side of the intake system generally opposite the engine body.

10. The watercraft of claim 9, wherein said intake system includes a carburetor, and said accelerating pump is positioned on said carburetor.

11. The watercraft of claim 10, wherein said carburetor includes a throttle valve having a throttle shaft, and the fuel increasing mechanism additionally includes means for activating said pump in response to movement of the throttle shaft.

12. The watercraft of claim 10 additionally comprising a throttle valve including a throttle shaft and an actuator operating between the throttle shaft and the accelerating pump to actuate the pump in response to movement of the throttle shaft.

13. The watercraft of claim 10, wherein the carburetor is a floatless-type carburetor.

14. The watercraft of claim 9 additionally comprising an actuating mechanism associated with the accelerating pump.

15. The watercraft of claim 14, wherein the actuating mechanism is disposed to a side of the engine body and entirely on a side of the intake system opposite the engine body.

16. The watercraft of claim 9, wherein the accelerating pump includes a fuel supply chamber.

17. The watercraft of claim 9, wherein the accelerating pump is positioned on a side of the intake system facing toward a bottom of the hull.

18. The watercraft of claim 9, wherein the engine is disposed within the engine compartment at an inclined orientation relative to a central vertical plane of the hull.

19. The watercraft of claim 18, wherein at least a portion of the intake system is disposed beneath a portion of the engine body.

20. The watercraft of claim 9, wherein the primary fuel supply system includes at least one fuel line, and the fuel line is disposed to a side of the engine body and on a side of the intake system generally opposite the accelerating pump.

* * * * *